US006853145B2

(12) United States Patent
Kang et al.

(10) Patent No.: US 6,853,145 B2
(45) Date of Patent: Feb. 8, 2005

(54) METHOD AND APPARATUS FOR DRIVING PLASMA DISPLAY PANEL

(75) Inventors: Seong Ho Kang, Daegu (KR); Sang Jin Yun, Pohang-shi (KR)

(73) Assignee: LG Electronics Inc., Seoul (KR)

( * ) Notice: Subject to any disclaimer, the term of this patent is extended or adjusted under 35 U.S.C. 154(b) by 0 days.

(21) Appl. No.: 10/630,687

(22) Filed: Jul. 31, 2003

(65) Prior Publication Data

US 2004/0021656 A1 Feb. 5, 2004

(30) Foreign Application Priority Data

Aug. 1, 2002 (KR) ..... P2002-0045606
Aug. 1, 2002 (KR) ..... P2002-0045607

(51) Int. Cl.[7] ..... G09G 3/30

(52) U.S. Cl. ..... 315/169.1; 315/169.3; 345/60; 345/76

(58) Field of Search ..... 315/169.3, 169.1; 345/76, 60, 77

(56) References Cited

U.S. PATENT DOCUMENTS 5,321,419 A * 6/1994 Katakura et al. ..... 345/97
5,754,154 A * 5/1998 Katakura et al. ..... 345/97

FOREIGN PATENT DOCUMENTS

JP 2002207449 7/2002

* cited by examiner

*Primary Examiner*—David Vu
(74) *Attorney, Agent, or Firm*—Fleshner & Kim, LLP

(57) ABSTRACT

A method and apparatus of driving a plasma display panel that is adaptive for making a stable operation at both a low temperature and a high temperature. In the apparatus, a scan driver supplies a rising ramp waveform in a set-up interval and a falling ramp waveform in a set-down interval. A temperature sensor senses a driving temperature of the panel to generate a bit control signal. A set-down control signal generator generates a control signal such that an application time of the falling ramp waveform can be controlled in correspondence with said bit control signal and for applying the control signal to the scan driver.

26 Claims, 12 Drawing Sheets

METHOD AND APPARATUS FOR DRIVING PLASMA DISPLAY PANEL

BACKGROUND OF THE INVENTION

1. Field of the Invention

This invention relates to a plasma display panel, and more particularly to a method and apparatus of driving a plasma display panel that is adaptive for making a stable operation at both a low temperature and a high temperature.

2. Description of the Related Art

Generally, a plasma display panel (PDP) excites and radiates a phosphorus material using an ultraviolet ray generated upon discharge of an inactive mixture gas such as He+Xe, Ne+Xe or He+Ne+Xe, to thereby display a picture. Such a PDP is easy to be made into a thin-film and large-dimension type. Moreover, the PDP provides a very improved picture quality owing to a recent technical development.

Referring to FIG. 1, a discharge cell of a conventional three-electrode, AC surface-discharge PDP includes a sustain electrode pair having a scan electrode 30Y, a common sustain electrode 30Z provided on an upper substrate 10, and an address electrode 20X provided on a lower substrate 18 in such a manner to perpendicularly cross the sustain electrode pair. Each of the scan electrode 30Y and the common sustain electrode 30Z has a structure disposed with transparent electrodes 12Y and 12Z and metal bus electrodes 13Y and 13Z thereon. On the upper substrate 10 provided, in parallel, with the scan electrode 30Y and the common sustain electrode 30Z, an upper dielectric layer 14 and an MgO protective film 16 are disposed. A lower dielectric layer 22 and barrier ribs 24 are formed on the lower substrate 18 provided with the address electrode 20X, and a phosphorous material layer 26 is coated onto the surfaces of the lower dielectric layer 22 and the barrier ribs 24. An inactive mixture gas such as He+Xe, Ne+Xe or He+Ne+Xe is injected into a discharge space among the upper substrate 10, the lower substrate 18 and the barrier ribs 24.

Such a PDP makes a time-divisional driving of one frame, which is divided into various sub-fields having a different emission frequency, so as to realize gray levels of a picture. Each sub-field is again divided into an initialization period for initializing the entire field, an address period for selecting a scan line and selecting the cell from the selected scan line and a sustain period for expressing gray levels depending on the discharge frequency. The initialization period is divided into a set-up interval supplied with a rising ramp waveform and a set-down interval supplied with a falling ramp waveform.

For instance, when it is intended to display a picture of 256 gray levels, a frame interval equal to 1/60 second (i.e. 16.67 msec) is divided into 8 sub-fields SF1 to SF8 as shown in FIG. 2. Each of the 8 sub-field SF1 to SF8 is divided into an initialization period, an address period and a sustain period as mentioned above. Herein, the initialization period and the address period of each sub-field are equal for each sub-field, whereas the sustain period and the number of sustain pulses assigned thereto are increased at a ratio of $2^n$ (wherein n=0, 1, 2, 3, 4, 5, 6 and 7) at each sub-field.

FIG. 3 shows a driving waveform of the PDP applied to two sub-fields. Herein, Y represents the scan electrode; Z does the common sustain electrode; and X does the address electrode.

Referring to FIG. 3, the PDP is divided into an initialization period for initializing the full field, an address period for selecting a cell, and a sustain period for sustaining a discharge of the selected cell for its driving.

In the initialization period, a rising ramp waveform Ramp-up is simultaneously applied all the scan electrodes Y in a set-up interval SU. A discharge is generated within the cells at the full field with the aid of the rising ramp waveform Ramp-up. By this set-up discharge, positive wall charges are accumulated onto the address electrode X and the sustain electrode Z while negative wall charges are accumulated onto the scan electrode Y. In a set-down interval SD, a falling ramp waveform Ramp-down falling from a positive voltage lower than a peak voltage of the rising ramp waveform Ramp-up is simultaneously applied to the scan electrodes Y after the rising ramp waveform Ramp-up was applied. The falling ramp waveform Ramp-down causes a weak erasure discharge within the cells to erase a portion of excessively formed wall charges. Wall charges enough to generate a stable address discharge are uniformly left within the cells with the aid of the set-down discharge.

In the address period, a negative scanning pulse scan is sequentially applied to the scan electrodes Y and, at the same time, a positive data pulse data is applied to the address electrodes X in synchronization with the scanning pulse scan. A voltage difference between the scanning pulse scan and the data pulse data is added to a wall voltage generated in the initialization period to thereby generate an address discharge within the cells supplied with the data pulse data. Wall charges enough to cause a discharge when a sustain voltage is applied are formed within the cells selected by the address discharge.

Meanwhile, a positive direct current voltage Zdc is applied to the common sustain electrodes Z during the set-down interval and the address period. The direct current voltage Zdc causes a set-down discharge between the common sustain electrode Z, and allows an address discharge generated between the scan electrode Y and the address electrode X in the address period to be transited into a surface discharge between the scan electrode Y and the common sustain electrode Z.

In the sustain period, a sustaining pulse sus is alternately applied to the scan electrodes Y and the common sustain electrodes Z. Then, a wall voltage within the cell selected by the address discharge is added to the sustain pulse sus to thereby generate a sustain discharge, that is, a display discharge between the scan electrode Y and the common sustain electrode Z whenever the sustain pulse sus is applied.

Finally, after the sustain discharge was finished, a ramp waveform erase having a small pulse width and a low voltage level is applied to the common sustain electrode Z to thereby erase wall charges left within the cells of the entire field.

However, such a conventional PDP has a problem in that a brightness point mis-discharge or no discharge occurs at a high temperature (i.e., more than 40° C.) and a low temperature (i.e., approximately 20° C. to −50° C.) upon driving. More specifically, when the PDP is driven at a high temperature atmosphere more than about 40° C. with being divided into a first half and a second half as shown in FIG. 4, that is, by a double scan strategy, there is raised a problem in that no address discharge occurs at the middle portion 41 of the screen having a late scanning sequence. Likewise, when the PDP is scanned at a high temperature atmosphere more than about 40° C. sequentially from the first line until the last line as shown in FIG. 5, that is, by a single scan strategy, there is raised a problem in that no address discharge occurs at the lower portion 51 of the screen having a late scanning sequence.

As a result of many experiments and analyses as to the experiments, a major factor causing a misfire at a high temperature atmosphere is because a loss amount of wall charges generated in the initialization period is more increased as a scanning sequence is later. Such a factor will be described on a basis of a discharge characteristic change within the cell below. Firstly, as an internal/external temperature of the cell rises, wall charges are lost due to a leakage current generated from deterioration in an insulation property of a dielectric material and a protective layer within the cell. Secondary, as a motion of space charges within the cell is more activated, a re-combination of the space charges with atoms having lost electrons is easily generated. Thus, wall charges and space charges contributed to the discharge are lost with the lapse of time.

Furthermore, when the PDP is driven at a low temperature atmosphere less than 20° C., a motion of particles becomes dull to generate a brightness point misfire. More specifically, if a motion of particles becomes dull at a low temperature, then an erasure discharge caused by an erasing ramp waveform erase is not normally generated. Wall charges formed at the scan electrode Y and the common sustain electrode Z are not erased from the cells having such an abnormal erasure discharge.

Thereafter, a positive rising ramp waveform Ramp-up is applied to the scan electrode Y in the set-up interval. At this time, since negative wall charges has been formed at the scan electrode Y, that is, since a voltage applied to the scan electrode Y and wall charges having been formed at the scan electrode Y has an opposite polarity with respect to each other, a normal discharge is not generated in the set-up interval. Further, in the set-down interval following the set-up interval, a normal discharge is not generated. If a normal discharge does not occur in the initialization period, then wall charges formed excessively in the erasure period make an affect to the address period and the sustain period. In other words, wall charges formed excessively at the discharge cells cause an undesired strong discharge taking a brightness point shape in the sustain period.

SUMMARY OF THE INVENTION

Accordingly, it is an object of the present invention to provide a method and apparatus of driving a plasma display panel that is adaptive for making a stable operation at both a low temperature and a high temperature.

In order to achieve these and other objects of the invention, a driving apparatus for a plasma display panel according to one aspect of the present invention includes a scan driver for supplying a rising ramp waveform in a set-up interval and a falling ramp waveform in a set-down interval; a temperature sensor for sensing a driving temperature of the panel to generate a bit control signal; and a set-down control signal generator for generating a control signal such that an application time of the falling ramp waveform can be controlled in correspondence with said bit control signal and for applying the control signal to the scan driver.

In the driving apparatus, said temperature sensor generates different bit control signals at a high temperature and at a temperature less than the high temperature.

Herein, said set-down control signal generator sets a width of said control signal such that a width of the control signal applied at said high temperature is narrower than that of the control signal applied at a temperature less than the high temperature in correspondence with said bit control signal.

Said scan driver supplies said falling ramp waveform during a time corresponding to said width of the control signal.

Said temperature sensor divides the high temperature into a plurality of temperature levels, and generates said different bit control signals for each temperature level.

Said set-down control signal generator generates a control signal having a narrower width as the temperature level goes higher, and said scan driver supplies said falling ramp waveform during a time corresponding to said width of the control signal.

A driving apparatus for a plasma display panel according to another aspect of the present invention includes a scan driver for supplying a rising ramp waveform in a set-up interval and a falling ramp waveform in a set-down interval; a temperature sensor for sensing a driving temperature of the panel to generate a bit control signal; and a set-up control signal generator for generating a control signal such that an application time of the rising ramp waveform can be controlled in correspondence with said bit control signal and for applying the control signal to the scan driver.

In the driving apparatus, said temperature sensor generates different bit control signals at a low temperature and at a temperature more than the low temperature.

Herein, said set-up control signal generator sets a width of said control signal such that a width of the control signal applied at said low temperature is narrower than that of the control signal applied at said temperature more than the low temperature in correspondence with said bit control signal.

Said scan driver supplies said rising ramp waveform during a time corresponding to said width of the control signal.

Said temperature sensor divides the low temperature into a plurality of temperature levels, and generates said different bit control signals for each temperature level.

Said set-up control signal generator generates a control signal having a larger width as the temperature level goes lower, and said scan driver supplies said rising ramp waveform during a time corresponding to said width of the control signal.

A driving apparatus for a plasma display panel according to still another aspect of the present invention includes a scan driver for supplying a rising ramp waveform in a set-up interval and a falling ramp waveform in a set-down interval; a first temperature sensor for sensing a driving temperature of the panel to generate a first bit control signal; a second temperature sensor for sensing a driving temperature of the panel to generate a second bit control signal; a set-up control signal generator for generating a first control signal such that an application time of the rising ramp waveform can be controlled in correspondence with said first bit control signal and for applying the first control signal to the scan driver; and a set-down control signal generator for generating a second control signal such that an application time of the falling ramp waveform can be controlled in correspondence with said second bit control signal and for applying the second control signal to the scan driver.

In the driving apparatus, said first temperature sensor generates first different bit control signals at a low temperature and at a temperature more than the low temperature, and said second temperature generates second different bit control signals at a high temperature and a temperature less than the high temperature.

Herein, said set-up control signal generator sets a width of said first control signal such that a width of the first control signal applied at said low temperature is larger than that of the first control signal applied at said temperature more than the low temperature in correspondence with said first bit control signal, and said set-down control signal generator sets a width of said second control signal such that a width of the second control signal applied at said high temperature is narrower than that of the second control signal applied at said temperature less than the high temperature in correspondence with said second bit control signal.

Said scan driver supplies said rising ramp waveform during a time corresponding to said width of the first control signal, and supplies said falling ramp waveform during a time corresponding to said width of the second control signal.

Said first temperature sensor divides the low temperature into a plurality of temperature levels and generates said first different bit control signals for each low temperature level, and said second temperature sensor divides the high temperature into a plurality of temperature levels and generates said second different bit control signals for each high temperature level.

Said set-up control signal generator generates a first control signal having a larger width as the low temperature level goes lower, and said scan driver supplies said rising ramp waveform corresponding to said width of the first control signal.

Said set-down control signal generator generates a second control signal having a narrower width as the high temperature level goes higher, and said scan driver supplies said falling ramp waveform corresponding to said width of the second control signal.

A method of driving a plasma display panel according to still another aspect of the present invention includes the steps of applying a rising ramp waveform to a scan electrode in a set-up interval; applying a falling ramp waveform to the scan electrode in a set-down interval following said set-up interval; and differently setting an application time of said falling ramp waveform applied to the scan electrode at a high temperature and at a temperature less than the high temperature.

In the method, said application time of the falling ramp waveform at said high temperature is set to be shorter than that of the falling ramp waveform at said temperature less than the high temperature.

Herein, said high temperature is divided into a plurality of temperature levels, and said application time of the falling ramp waveform is more shortly set as said temperature level goes higher.

A method of driving a plasma display panel according to still another aspect of the present invention includes the steps of applying a rising ramp waveform to a scan electrode in a set-up interval; applying a falling ramp waveform to the scan electrode in a set-down interval following said set-up interval; and differently setting an application time of said rising ramp waveform applied to the scan electrode at a low temperature and at a temperature more than the low temperature.

In the method, said application time of the rising ramp waveform at said low temperature is set to be longer than that of the rising ramp waveform at said temperature more than the low temperature.

Herein, said low temperature is divided into a plurality of temperature levels, and said application time of the rising ramp waveform is longer set as said temperature level goes lower.

A slope of the rising ramp waveform applied at said low temperature is equal to that of the rising ramp waveform applied at said temperature more than the low temperature.

BRIEF DESCRIPTION OF THE DRAWINGS

These and other objects of the invention will be apparent from the following detailed description of the embodiments of the present invention with reference to the accompanying drawings, in which.

DETAILED DESCRIPTION OF THE PREFERRED EMBODIMENT

Figure 1:
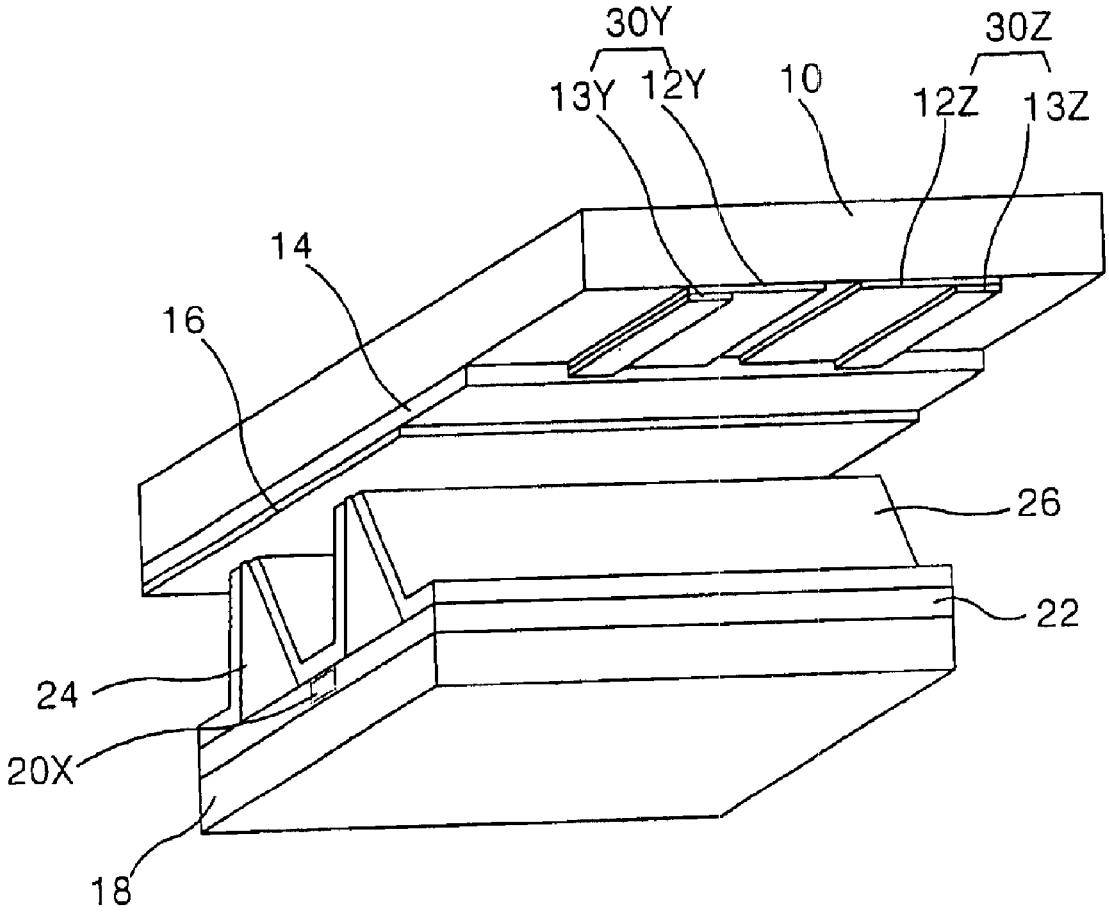
FIG. 1 RELATED ART
FIG. 1 is a perspective view showing a discharge cell structure of a conventional three-electrode, AC surface-discharge plasma display panel.
Figure 2:
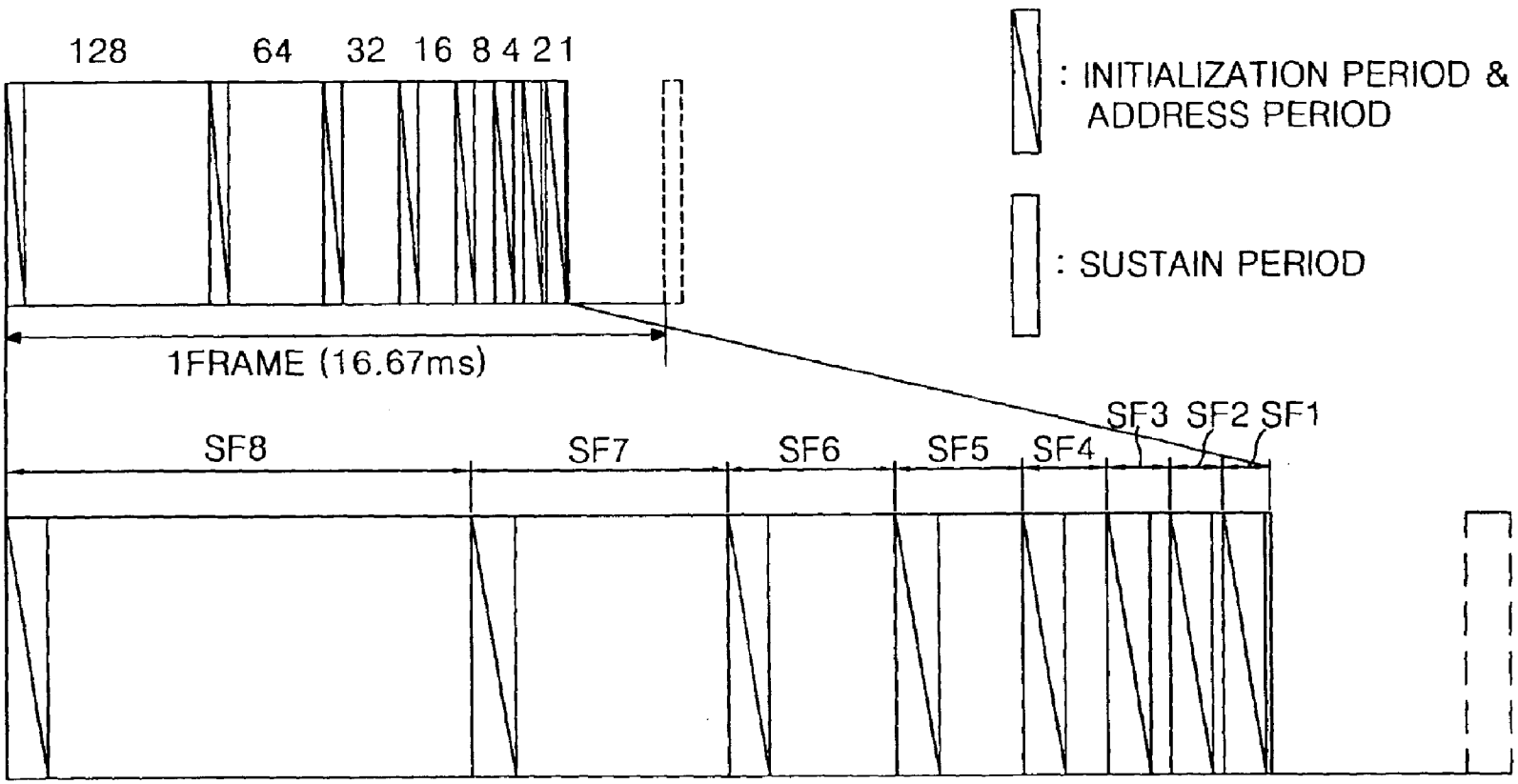
FIG.2 RELATED ART
FIG. 2 illustrates one frame in the conventional plasma display panel.
Figure 3:
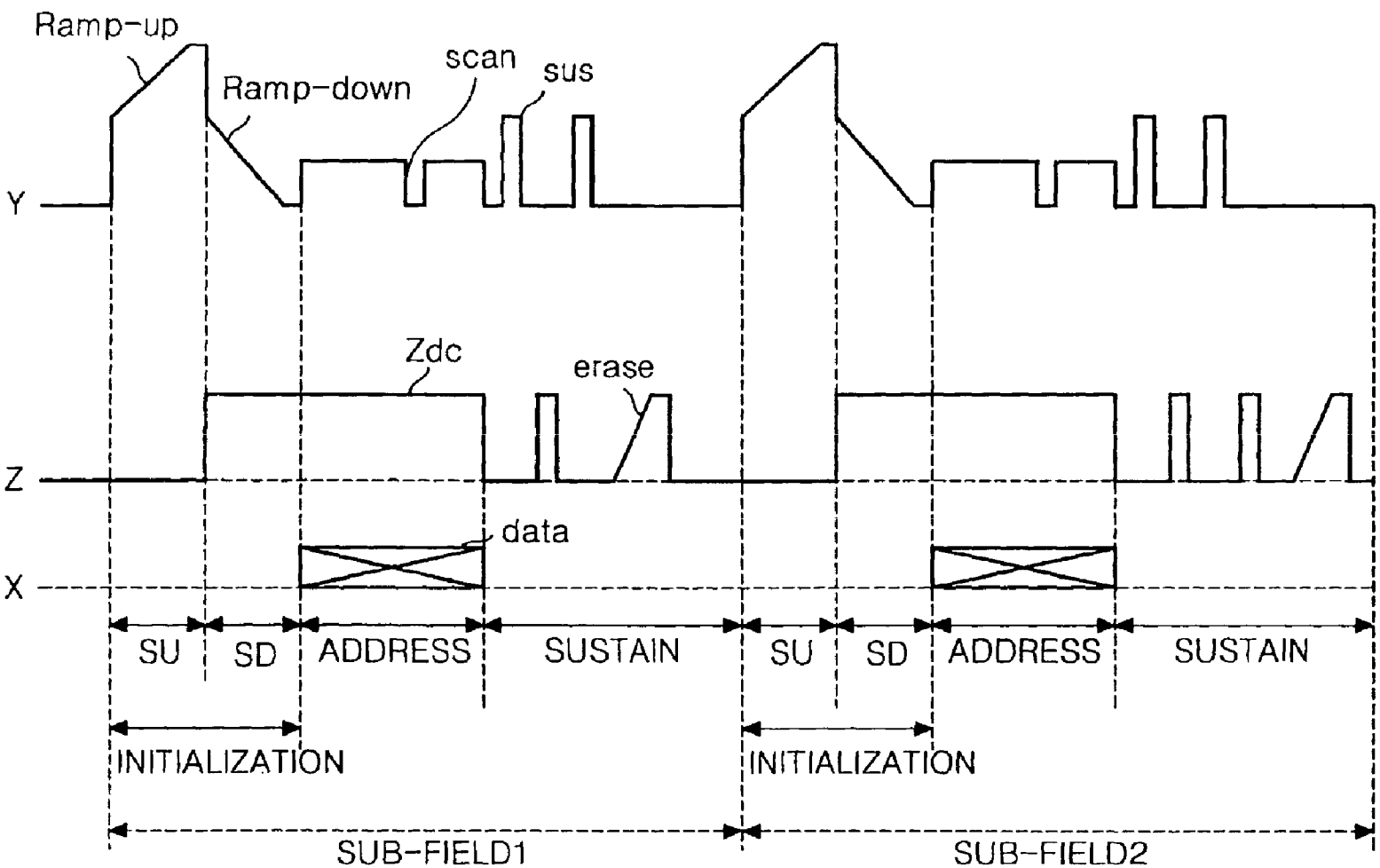
FIG. 3 RELATED ART
FIG. 3 is a waveform diagram showing a method of driving the conventional plasma display panel.
Figure 4:
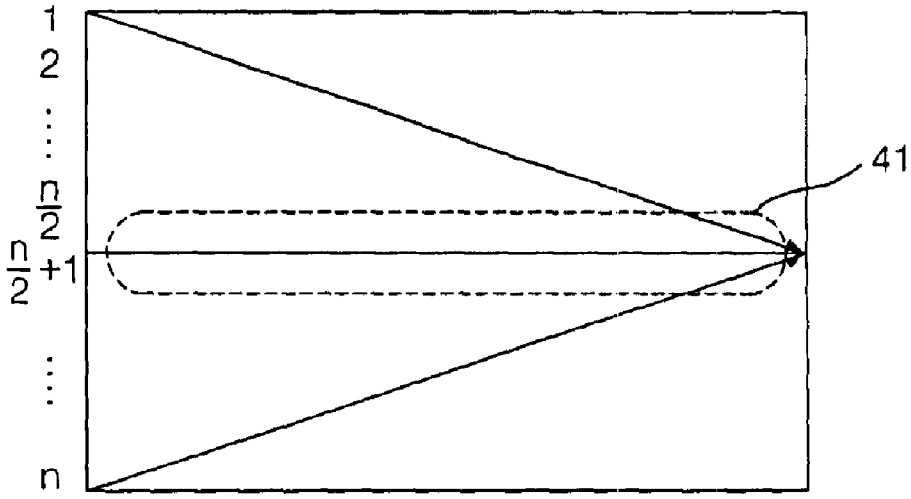
FIG. 4 RELATED ART
FIG. 4 and FIG. 5 depict an area having a misfire at a high temperature atmosphere in the conventional plasma display panel.
Figure 5:
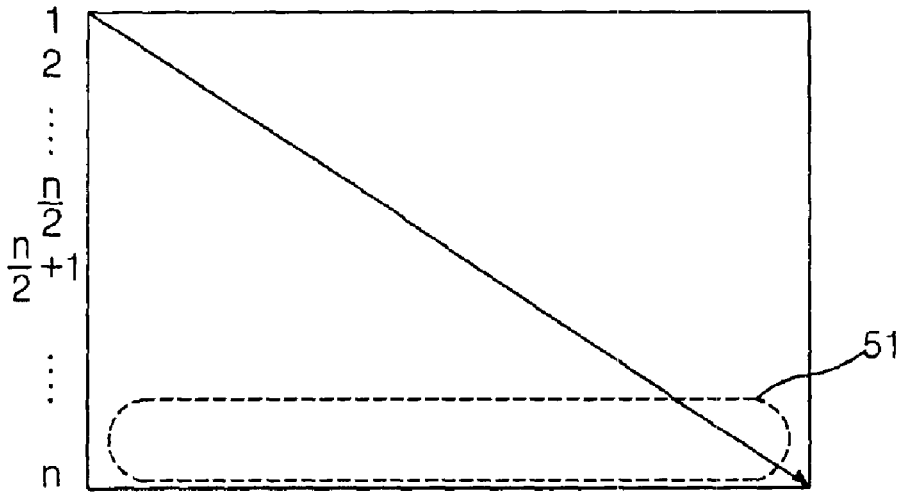
FIG. 5 RELATED ART
Figure 6:
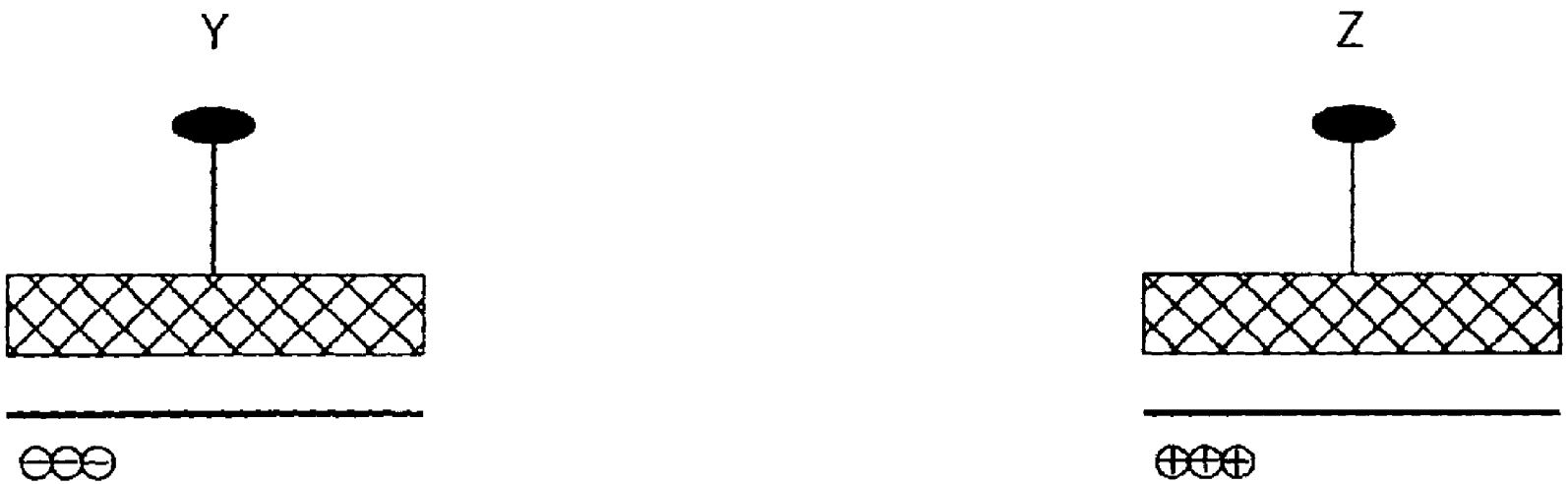
FIG. 6 RELATED ART
FIG. 6 depicts wall charges formed at the electrodes when a normal erasure discharge is not generated.
Figure 7:
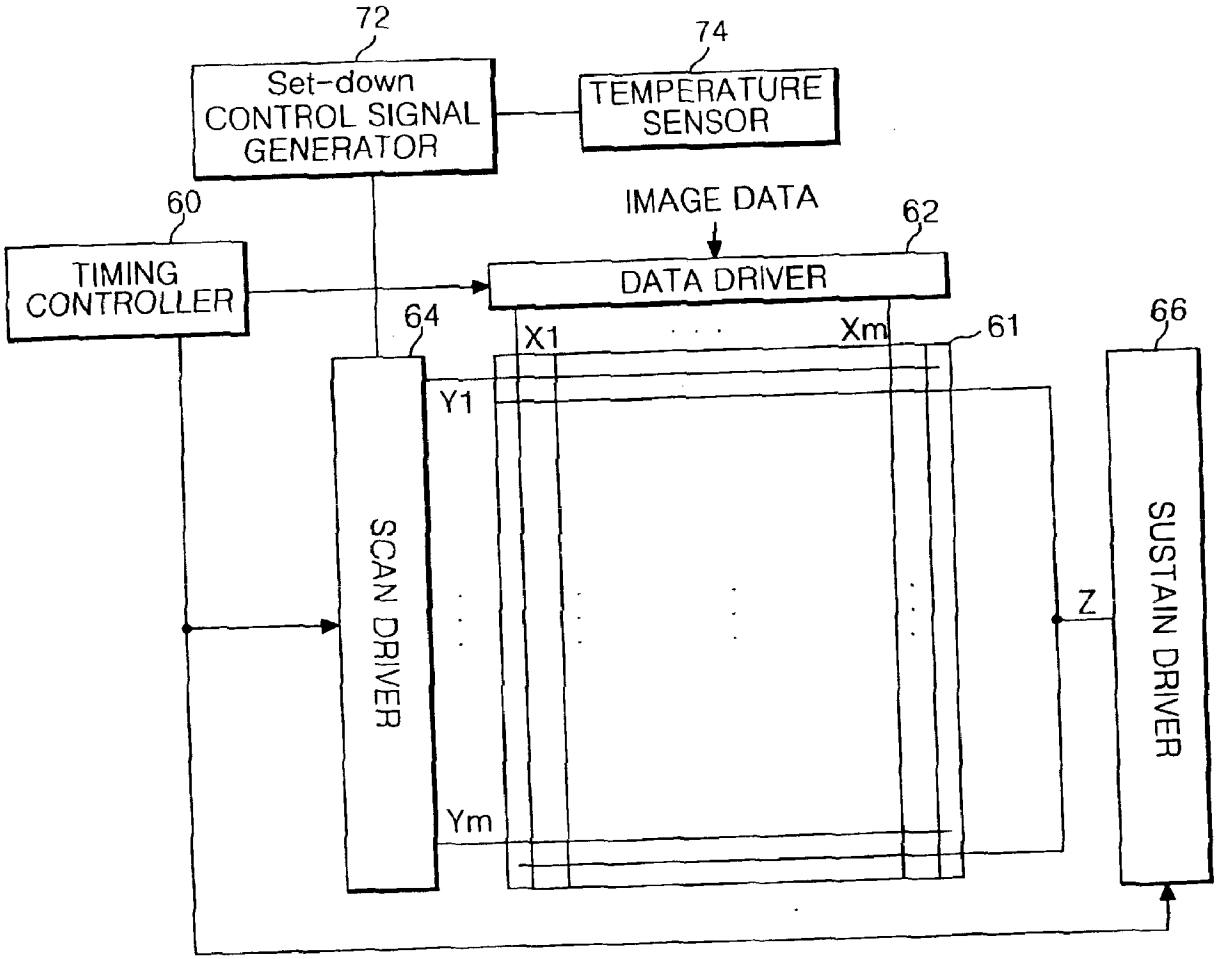
FIG. 7 is a block diagram showing a configuration of a driving apparatus for a plasma display panel according to a first embodiment of the present invention.

FIG. 7 shows a driving apparatus for a plasma display panel (PDP) according to a first embodiment of the present invention.

Referring to FIG. 7, the driving apparatus includes a data driver 62 for applying a data pulse to address electrodes X1 to Xm, a scan driver 64 for applying an initialization pulse, a scanning pulse and a sustaining pulse to scan electrodes Y1 to Ym, a sustain driver 66 for applying a positive direct current (DC) voltage and a sustaining pulse to a common sustain electrode Z, a timing controller 60 for controlling each driver 62, 64 and 66, a temperature sensor 74 for sensing a driving temperature of a panel 61, and a set-down control signal generator 72 for applying a set-down control signal to the scan driver 64.

The data driver 62 is subject to a reverse gamma correction and an error diffusion, etc. by a reverse gamma correcting circuit and an error diffusing circuit, etc. (not shown), and thereafter latches data mapped onto each sub-field by a sub-field mapping circuit (not shown) under control of the timing controller 60 and applies the latched data to the address electrodes X1 to Xm.

The scan driver 64 supplies a rising ramp waveform and a falling ramp waveform to the scan electrodes Y1 to Ym in the initialization period and then sequentially applies a scanning pulse for selecting a scan line to the scan electrodes Y1 to Ym in the address period. Further, the scan driver 64 simultaneously applies a sustaining pulse for causing a sustaining discharge for the cell selected in the address period to the scan electrodes Y1 to Ym. Such a scan driver 64 determines an application time of the falling ramp waveform applied in the set-down interval under control of the set-down control signal generator 72.

The sustain driver 66 supplies a DC voltage in the set-down interval and the address period, and supplies a sustaining pulse in the sustain period.

The timing controller 60 receives vertical and horizontal synchronizing signals to generate timing control signals required for each driver 62, 64 and 66, and applies the timing control signals to each driver 62, 64 and 66.

The temperature sensor 74 applies a desired bit control signal to the set-down control signal generator 72 with sensing a driving temperature of the panel 61. The temperature sensor 74 generates different bit control signals when the panel 61 is driven at a high temperature (i.e., more than about 40° C.) and when the panel 61 is driven at less than said high temperature and applies them to the set-down control signal generator 72.

Furthermore, the temperature sensor 74 divides a temperature more than said high temperature into a plurality of levels, and generates a bit control signal corresponding to the temperature level to apply it to the set-down control signal generator 72. For instance, the temperature sensor 74 may generate a 4-bit control signal corresponding to a driving temperature of the panel 61 to apply it to the set-down control signal generator 72.

The set-down control signal generator 72 applies a set-down control signal having a different width in correspondence with the bit control signal inputted from the temperature sensor 74 to the scan driver 64.

Figure 8:
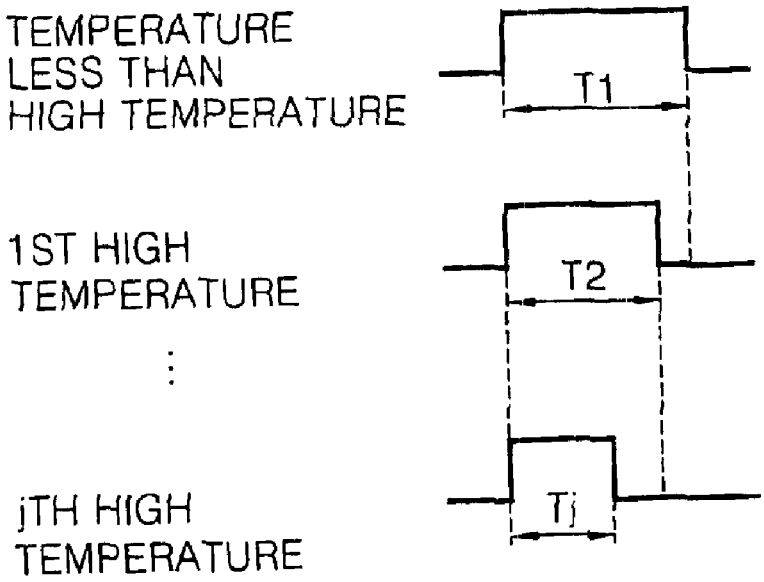
FIG. 8 is a waveform diagram of a control signal generated from the set-down control signal generator shown in FIG. 7.

In operation, the temperature sensor 74 applies a desired bit control signal (e.g., a control signal "0000") to the set-down control signal generator 72 when the panel 61 is operated at a temperature less than said high temperature. The set-down control signal generator 72 having received the control signal "0000" from the temperature sensor 74 applies a control signal having a width T1 as shown in FIG. 8 to the scan driver 64. At this time, the width T1 of the control signal applied from the set-down control signal generator 72 is set to be equal to that of the conventional set-down control signal.

The scan driver 64 receiving a control signal having a width T1 from the set-down control signal generator 72 supplies a falling ramp waveform Ramp-down during the T1 interval in the set-down interval.

Figure 9A:
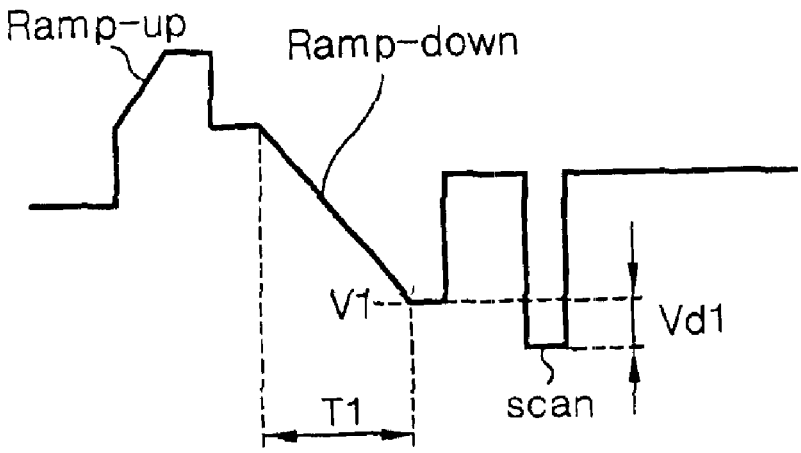
FIG. 9A to FIG. 9C illustrate falling ramp waveforms applied in correspondence with the control signal shown in FIG. 8.

This procedure will be described in detail. First, the scan driver 64 applies a rising ramp waveform Ramp-up to all the scan electrodes as shown in FIG. 9A in the set-up interval of the initialization period. This rising ramp waveform Ramp-up causes a set-up discharge within the cells of the full field, and the set-up discharge allows positive wall charges to be accumulated onto the address electrode X and the common sustain electrode Z and allows negative wall charges to be accumulated onto the scan electrode Y.

In the set-down interval, after the rising ramp waveform Ramp-up was supplied, a falling ramp waveform Ramp-down falling from a positive voltage lower than a peak voltage of the rising ramp waveform Ramp-up is simultaneously applied to the scan electrodes Y during the T1 interval. At this time, the falling ramp waveform Ramp-down falls into a voltage V1. Such a falling ramp waveform Ramp-down causes a weak erasure discharge within the cells to erase a portion of excessive wall charges. Meanwhile, the voltage V1 obtained by a falling of the falling ramp waveform Ramp-down has a voltage difference Vd1 from a voltage level of the scanning pulse scan applied in the address period.

The temperature sensor 74 applies a control signal "0001" to the set-down control signal generator 72 when the panel 61 is operated at a first high temperature (e.g., 42° C.) of the plurality of temperature levels. The set-down control signal generator 72 having received the control signal "0001" from the temperature sensor 74 applies a control signal having a width T2 narrower than the width T1 as shown in FIG. 8 to the scan driver 64.

The scan driver 64 having received a control signal having the width T2 from the set-down control signal generator 72 applies the falling ramp waveform Ramp-down during the T2 interval in the set-down interval.

Figure 9B:
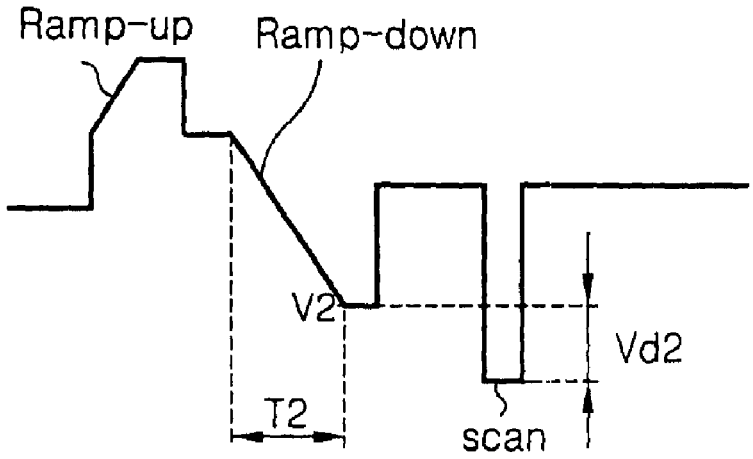
Figure 9C:
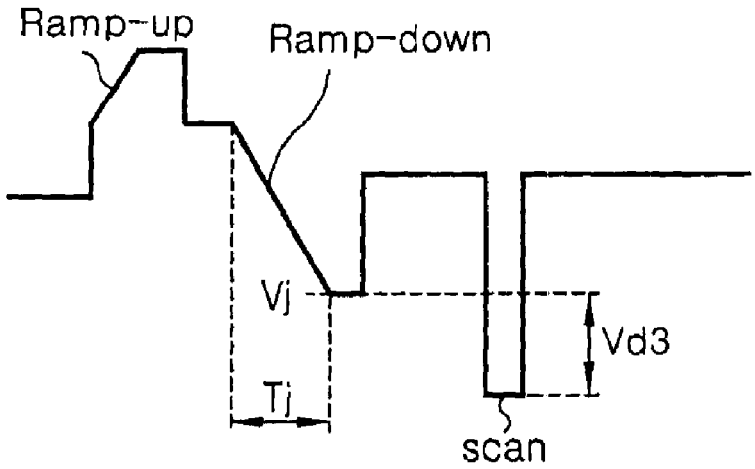

This procedure will be described in detail. First, the scan driver 64 applies a rising ramp waveform Ramp-up to all the scan electrodes as shown in FIG. 9B in the set-up interval of the initialization period. This rising ramp waveform causes a set-up discharge within the cells of the full field, and the set-up discharges allows positive wall charges to be accumulated onto the address electrode X and the common sustain electrode Z and allows negative wall charges to be accumulated onto the scan electrode Y.

In the set-down interval, after the rising ramp waveform Ramp-up was supplied, a falling ramp waveform Ramp-down falling from a positive voltage lower than a peak voltage of the rising ramp waveform Ramp-up is simultaneously applied to the scan electrodes Y during the T2 interval. At this time, the falling ramp waveform Ramp-down falls into a voltage V2 higher than the voltage V1. Such a falling ramp waveform Ramp-down causes a weak erasure discharge within the cells to erase a portion of excessive wall charges.

At this time, since the falling ramp waveform Ramp-down is supplied only during the T2 interval, an amount of wall charges left within the cells is increased in comparison with a temperature less than said high temperature. In the first embodiment of the present invention, as a higher temperature goes, an application time of the falling ramp waveform Ramp-down is more shortened to left a lot of wall charges within the cells. If a lot of wall charges are left within the cells in the initialization period, then it becomes possible to prevent a high-temperature misfire. In other words, a high-temperature misfire can be prevented by leaving a lot of wall charges in the initialization period so as to compensate for an amount of wall charges expired by a re-combination, etc. of wall charges at a high temperature atmosphere. Herein, the voltage V2 obtained by a falling of the falling ramp waveform Ramp-down has a voltage difference Vd2 from a voltage level of the scanning pulse scan supplied in the address period. In this case, the voltage difference Vd2 is set to be larger than the voltage difference Vd1.

In the mean time, the present set-down control signal generator 72 applies a control signal having a narrower width as a driving temperature of the panel 61 goes higher to the scan driver 64. In other words, the set-down control signal generator 72 applies a control signal having a narrower width Tj than the width T2 at a temperature level j (wherein j is an integer larger than 42) as shown in FIG. 8 to the scan driver 64. Thereafter, the scan driver 64 applies a falling ramp waveform Ramp-down to the scan electrode only during the Tj interval in the set-down interval to thereby prevent a high-temperature misfire. At this time, the falling ramp waveform Ramp-down falls into a voltage Vj higher than the voltage V1. Herein, the voltage Vj obtained by a falling of the falling ramp waveform Ramp-down has a voltage difference Vd3 from a voltage level of the scanning pulse scan supplied in the address period. In this case, the voltage difference Vd3 is set to be larger than the voltage difference Vd2.

Figure 10:
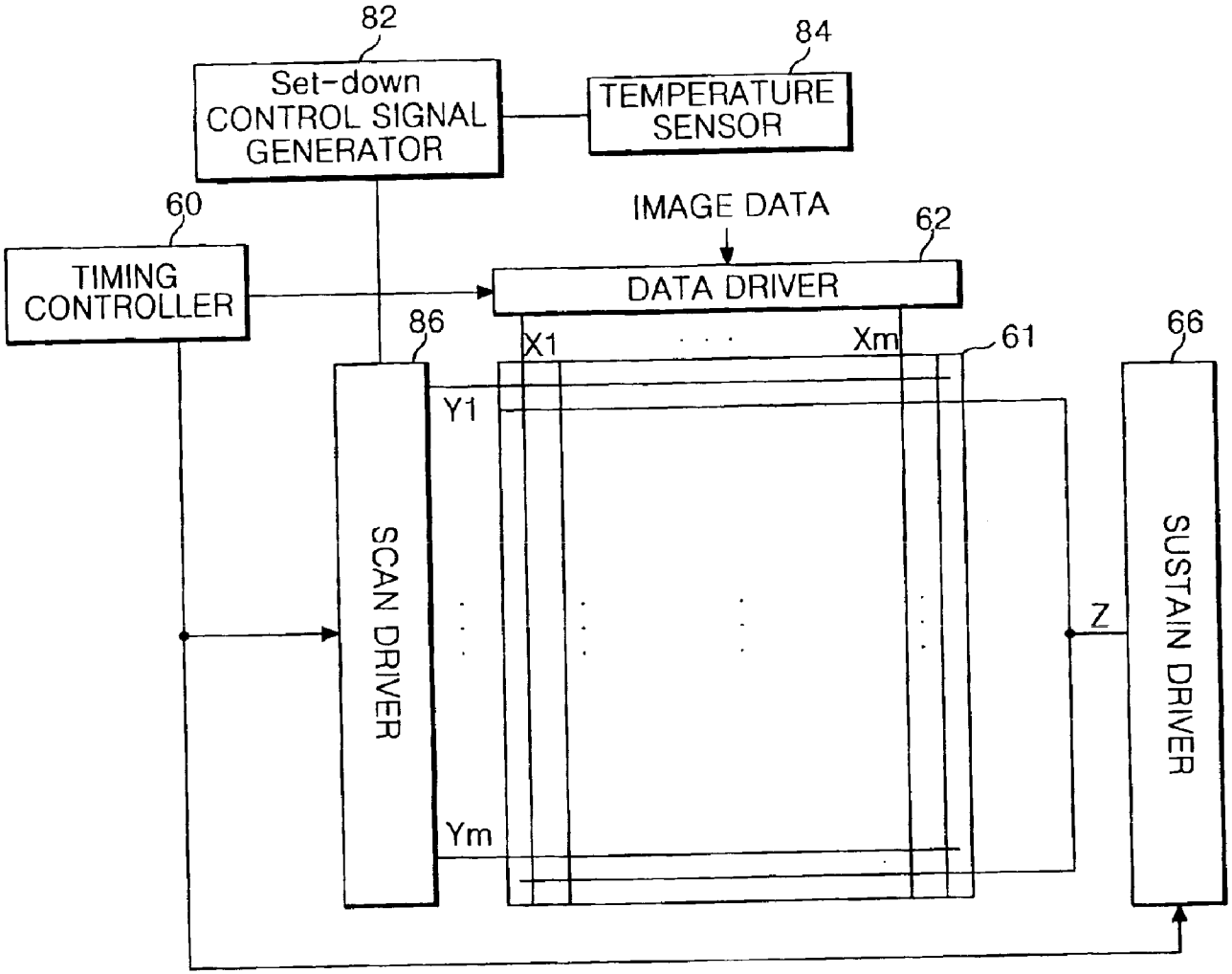
FIG. 10 is a block diagram showing a configuration of a driving apparatus for a plasma display panel according to a second embodiment of the present invention.

FIG. 10 shows a driving apparatus for a plasma display panel (PDP) according to a second embodiment of the present invention. Blocks of FIG. 10 having the same function as those of FIG. 7 are assigned into the same reference numerals, and a detailed explanation to these blocks will be omitted.

Referring to FIG. 10, the driving apparatus includes a data driver 62 for applying a data pulse to address electrodes X1 to Xm, a scan driver 86 for applying an initialization pulse, a scanning pulse and a sustaining pulse to scan electrodes Y1 to Ym, a sustain driver 66 for applying a positive direct current (DC) voltage and a sustaining pulse to a common sustain electrode Z, a timing controller 60 for controlling each driver 62, 64 and 66, a temperature sensor 84 for sensing a driving temperature of a panel 61, and a set-up control signal generator 82 for applying a set-up control signal to the scan driver 84.

The scan driver 86 supplies a rising ramp waveform and a falling ramp waveform to the scan electrodes Y1 to Ym in the initialization period and then sequentially applies a scanning pulse for selecting a scan line to the scan electrodes Y1 to Ym in the address period. Further, the scan driver 86 simultaneously applies a sustaining pulse for causing a sustaining discharge for the cell selected in the address period to the scan electrodes Y1 to Ym. Such a scan driver 84 determines an application time of the falling ramp waveform applied in the set-down interval under control of the set-up control signal generator 82.

The temperature sensor 84 applies a desired bit control signal to the set-up control signal generator 82 with sensing a driving temperature of the panel 61. The temperature sensor 84 generates different bit control signals when the panel 61 is driven at a low temperature (i.e., approximately 20° C. to −50° C.) and when the panel 61 is driven at a temperature higher than said low temperature and applies them to the set-up control signal generator 82.

Furthermore, the temperature sensor 84 divides a temperature more than said low temperature into a plurality of levels, and generates a different bit control signal for each temperature level to apply it to the set-up control signal generator 82. For instance, the temperature sensor 84 may generate a 4-bit control signal corresponding to a driving temperature of the panel 61 to apply it to the set-up control signal generator 82.

The set-up control signal generator 82 applies a set-up control signal having a different width in correspondence with the bit control signal inputted from the temperature sensor 84 to the scan driver 86.

Figure 11:
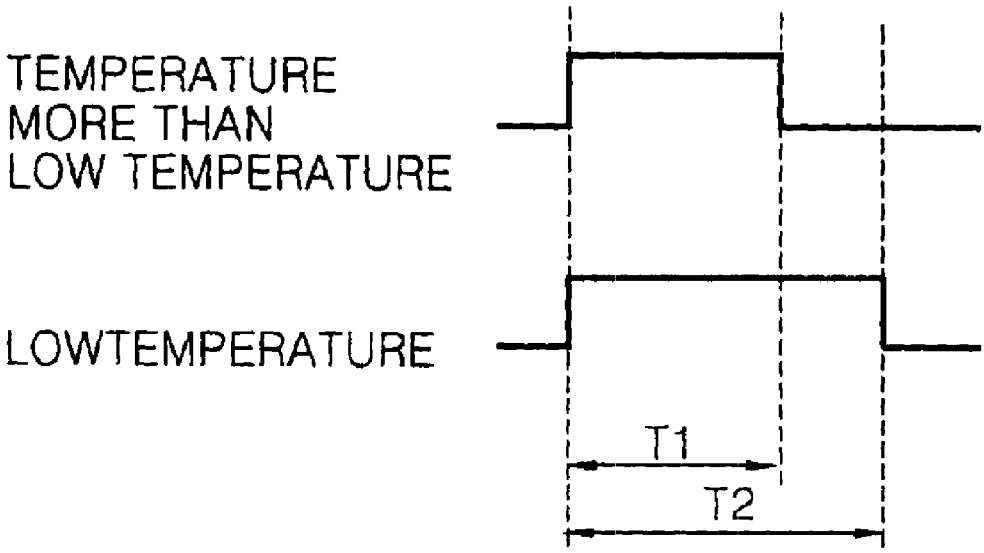
FIG. 11 is a waveform diagram of a control signal generated from the set-up control signal generator shown in FIG. 10.

In operation, the temperature sensor 84 applies a desired bit control signal (e.g., a control signal "0000") to the set-up control signal generator 82 when the panel 61 is operated at a temperature more than said low temperature. The set-up control signal generator 82 having received the control signal "0000" from the temperature sensor 84 applies a control signal having a width T1 as shown in FIG. 11 to the scan driver 86. At this time, the width T1 of the control signal applied from the set-up control signal generator 82 is set to be equal to that of the conventional set-down control signal.

The scan driver 86 having received a control signal having a width T1 from the set-up control signal generator 82 supplies a rising ramp waveform Ramp-up to the scan electrode during the T1 interval.

Figure 12:
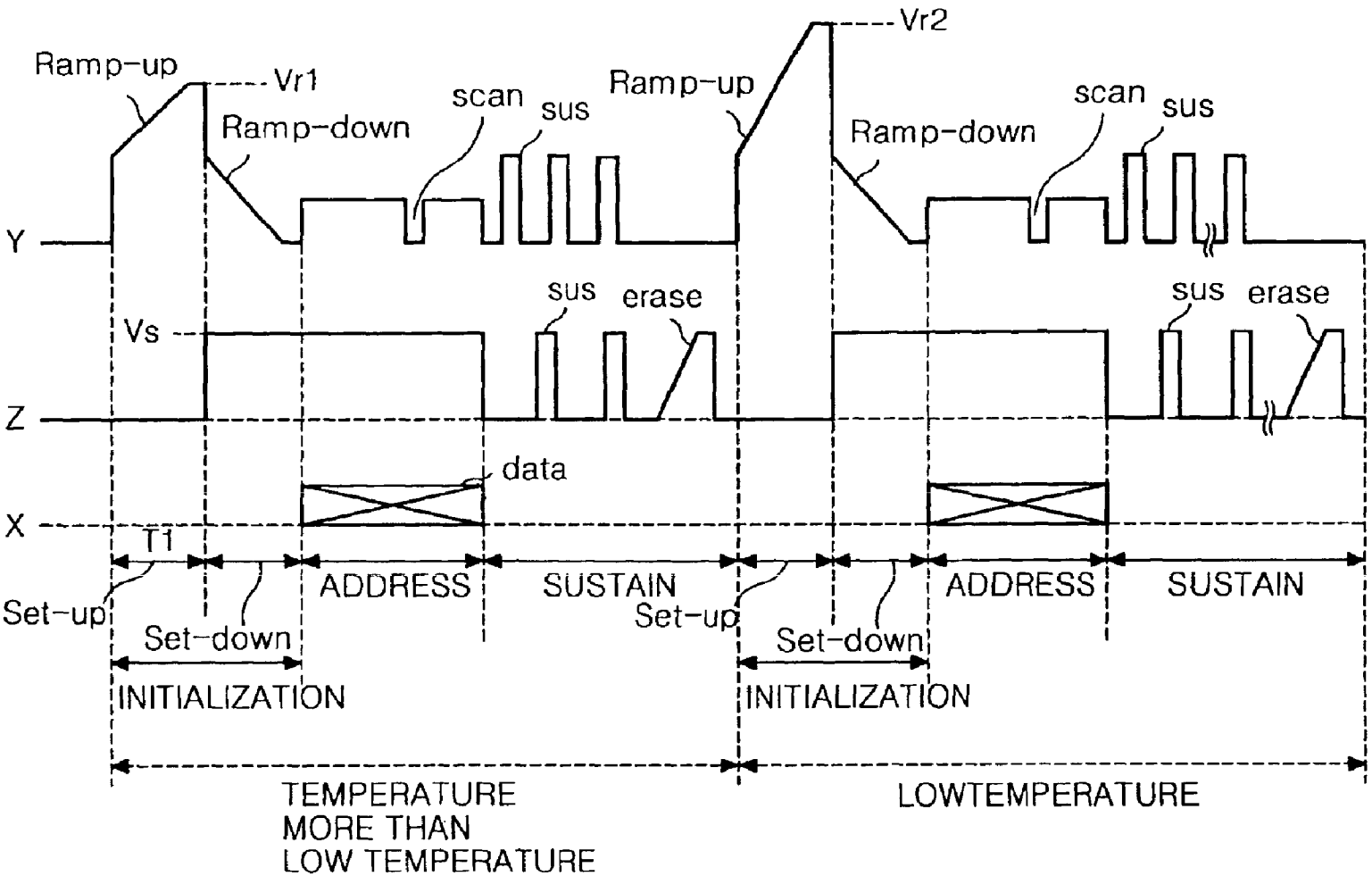
FIG. 12 illustrates a rising ramp waveform applied in correspondence with the control signal shown in FIG. 11.

This procedure will be described in detail. First, the scan driver 86 applies a rising ramp waveform Ramp-up to all the scan electrodes during the T1 interval when a driving temperature is higher than said low temperature, that is, when "0000" is inputted from the temperature sensor 84 as shown in FIG. 12. In other words, the set-up interval is set to T1. If the rising ramp waveform Ramp-up is applied to the scan electrodes Y, then a weak discharge is generated within the cells of the full field to form wall charges within the cells. Herein, the rising ramp waveform Ramp-up rises into a first peak voltage Vr1.

The temperature sensor 84 applies a desired bit control signal (e.g., a control signal "0001") to the set-up control signal generator 82 when the panel 61 is operated at a low temperature. The set-up control signal generator 82 having received the control signal "0001" from the temperature sensor 84 applies a control signal having a width T2 larger than the width T1 as shown in FIG. 11 to the scan driver 86.

The scan driver 86 having received a control signal having the width T2 from the set-up control signal generator 82 applies the rising ramp waveform Ramp-up during the T2 interval.

This procedure will be described in detail. First, the scan driver 86 applies a rising ramp waveform Ramp-up to all the scan electrodes Y during the T2 interval when a driving temperature is a low temperature, that is, when "0001" is inputted from the temperature sensor 84 as shown in FIG. 12. In other words, the set-up interval is set to T2. If the rising ramp waveform Ramp-up is applied to the scan electrodes Y, then a weak discharge is generated within the cells of the full field to form wall charges within the cells. Herein, the rising ramp waveform Ramp-up rises into a second peak voltage Vr2 higher than the first peak voltage Vr1.

In the second embodiment of the present invention, the rising ramp waveform Ramp-up supplied at a temperature more than said low temperature and the rising ramp waveform Ramp-up supplied at said low temperature has the same slope. However, the rising ramp waveform Ramp-up is supplied during a first time T1 at a temperature more than said low temperature. On the other hand, the rising ramp waveform Ramp-up is supplied during a second time T2 longer than the first time T1 (i.e., T2>T1) at said low temperature. Accordingly, the peak voltage Vr2 of the rising ramp waveform Ramp-up supplied at said low temperature is set to be higher than the peak voltage Vr1 of the rising ramp waveform Ramp-up supplied at a temperature more than said low temperature (i.e., Vr2>Vr1)

If the rising ramp waveform Ramp-up having a high peak voltage Vr2 is applied to the scan electrode Y when the PDP is driven at a low temperature as mentioned above, then a high voltage difference is generated between the scan electrode Y and the common sustain electrode Z to thereby cause a stable set-up discharge at a low temperature.

Herein, the temperature sensor 84 applies a bit control signal corresponding to the temperature level to the set-up control signal generator 82. Then, the set-up control signal generator 82 generates a control signal having a larger width of the temperature level. Accordingly, as a temperature level goes lower, the rising ramp waveform Ramp-up rising into a higher voltage is applied to the scan electrode Y.

Meanwhile, a combination of the first embodiment shown in FIG. 7 and the second embodiment shown in FIG. 10 may be applicable to the present invention. In other words, an apparatus as shown in FIG. 13 may be configured so that the PDP can make a stable driving at both a low temperature and a high temperature.

Figure 13:
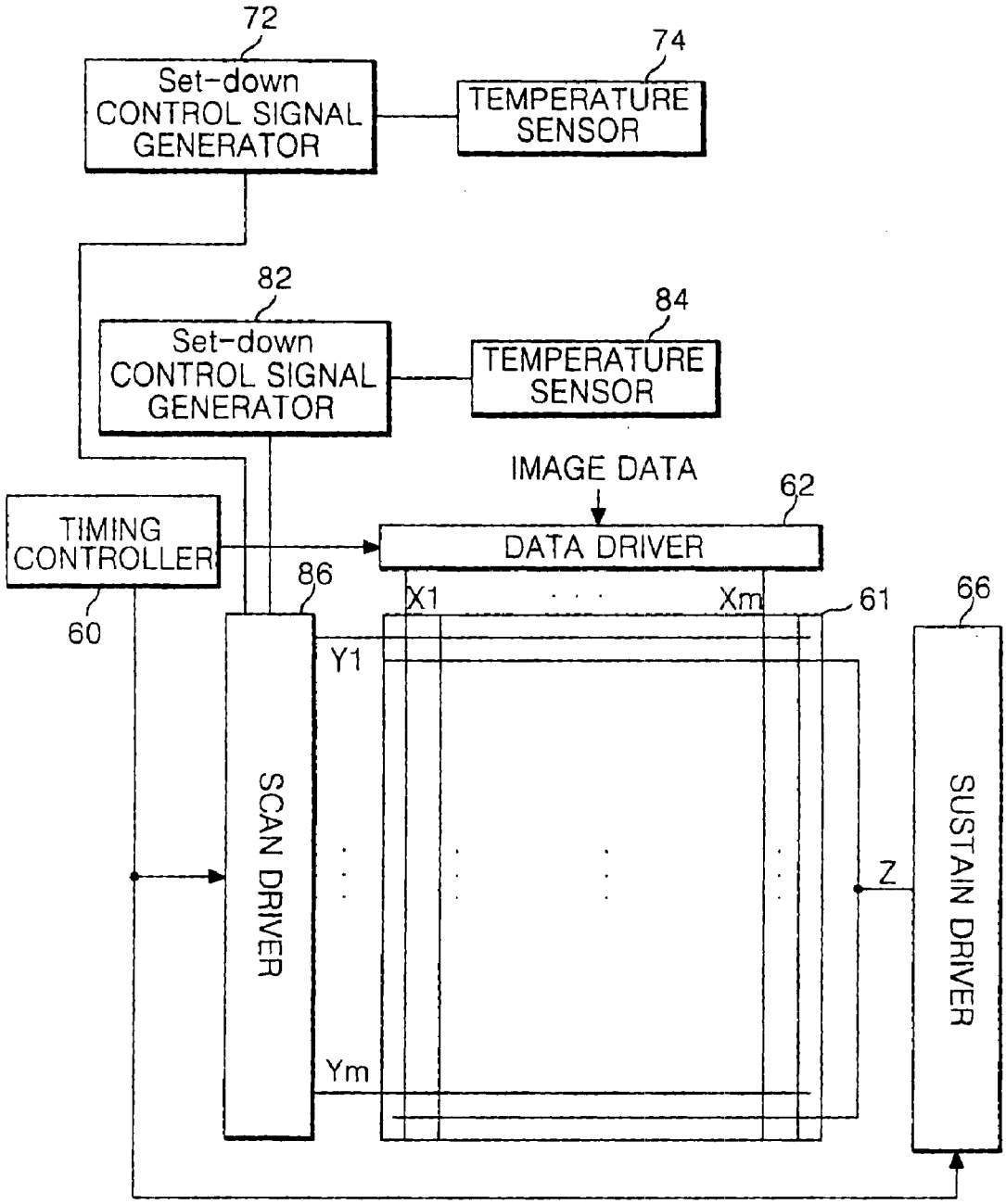
FIG. 13 is a block diagram showing a configuration of a driving apparatus for a plasma display panel according to a third embodiment of the present invention.

Referring to FIG. 13, a driving apparatus according to a third embodiment of the present invention includes a data driver 62 for applying a data pulse to address electrodes X1 to Xm, a scan driver 86 for applying an initialization pulse, a scanning pulse and a sustaining pulse to scan electrodes Y1 to Ym, a sustain driver 66 for applying a positive direct current (DC) voltage and a sustaining pulse to a common sustain electrode Z, a timing controller 60 for controlling each driver 62, 64 and 66, first and second temperature sensors 74 and 84 for sensing a driving temperature of a panel 61, a set-up control signal generator 82 for applying a set-up control signal to the scan driver 86, and a set-down control signal generator 72 for applying a set-down control signal to the scan driver 86.

The first temperature sensor 74 applies a desired bit control signal to the set-down control signal generator 72 with sensing a driving temperature of the panel 61. The first temperature sensor 74 generates a bit control signals when the panel 61 is driven at a high temperature and applies the bit control signal to the set-down control signal generator 72. Herein, the first temperature sensor 74 divides the high temperature into a plurality of temperature levels and generates a bit control signal corresponding to said temperature levels.

The set-down control signal generator 72 generates a set-down control signal having a narrower width as a temperature goes higher in correspondence with the bit control signal inputted from the first temperature sensor 74 and applies it to the scan driver 86. Then, the scan driver 86 establishes a falling ramp waveform Ramp-down in correspondence with a width of the set-down control signal to thereby cause a stable discharge at a high temperature.

The second temperature sensor 84 applies a desired bit control signal to the set-up control signal generator 82 with sensing a driving temperature of the panel 61. The second temperature sensor 84 generates a bit control signals when the panel 61 is driven at a low temperature and applies the bit control signal to the set-up control signal generator 82. Herein, the second temperature sensor 84 divides the low temperature into a plurality of temperature levels and generates a bit control signal corresponding to said temperature levels.

The set-up control signal generator 82 generates a set-up control signal having a larger width as a temperature goes lower in correspondence with the bit control signal inputted from the first temperature sensor 74 and applies it to the scan driver 86. Then, the scan driver 86 establishes a rising ramp waveform Ramp-up in correspondence with a width of the set-up control signal to thereby cause a stable discharge at a low temperature.

As described above, according to the present invention, an application time of the rising ramp waveform when the panel is driven at a low temperature is set to be longer than that of the rising ramp waveform when the panel is driven at a temperature more than said low temperature, that is, the rising ramp waveform having a high voltage is applied, thereby causing a stable set-up discharge at a low temperature. Accordingly, the plasma display panel according to the present invention is operated at a low temperature. Furthermore, according to the present invention, an application time of the set-down ramp waveform is shortly set such that an amount of residual wall charges within the cell when the panel is driven at a high temperature can be more than an amount of residual wall charges within the cell when the panel is driven at a temperature less than said high temperature, thereby making a stable operation at a high temperature.

Although the present invention has been explained by the embodiments shown in the drawings described above, it should be understood to the ordinary skilled person in the art that the invention is not limited to the embodiments, but rather that various changes or modifications thereof are possible without departing from the spirit of the invention. Accordingly, the scope of the invention shall be determined only by the appended claims and their equivalents.

What is claimed is:

1. A driving apparatus for a plasma display panel, comprising:

a scan driver for supplying a rising ramp waveform in a set-up interval and a falling ramp waveform in a set-down interval;

a temperature sensor for sensing a driving temperature of the panel to generate a bit control signal; and a set-down control signal generator for generating a control signal such that an application time of the falling ramp waveform can be controlled in correspondence with said bit control signal and for applying the control signal to the scan driver.

2. The driving apparatus as claimed in claim 1, wherein said temperature sensor generates different bit control signals at a high temperature and at a temperature less than the high temperature.

3. The driving apparatus as claimed in claim 2, wherein said set-down control signal generator sets a width of said control signal such that a width of the control signal applied at said high temperature is narrower than that of the control signal applied at a temperature less than the high temperature in correspondence with said bit control signal.

4. The driving apparatus as claimed in claim 3, wherein said scan driver supplies said falling ramp waveform during a time corresponding to said width of the control signal.

5. The driving apparatus as claimed in claim 2, wherein said temperature sensor divides the high temperature into a plurality of temperature levels, and generates said different bit control signals for each temperature level.

6. The driving apparatus as claimed in claim 5, wherein said set-down control signal generator generates a control signal having a narrower width as the temperature level goes higher, and said scan driver supplies said falling ramp waveform during a time corresponding to said width of the control signal.

7. A driving apparatus for a plasma display panel, comprising:

a scan driver for supplying a rising ramp waveform in a set-up interval and a falling ramp waveform in a set-down interval;

a temperature sensor for sensing a driving temperature of the panel to generate a bit control signal; and a set-up control signal generator for generating a control signal such that an application time of the rising ramp waveform can be controlled in correspondence with said bit control signal and for applying the control signal to the scan driver.

8. The driving apparatus as claimed in claim 7, wherein said temperature sensor generates different bit control signals at a low temperature and at a temperature more than the low temperature.

9. The driving apparatus as claimed in claim 8, wherein said set-up control signal generator sets a width of said control signal such that a width of the control signal applied at said low temperature is narrower than that of the control signal applied at said temperature more than the low temperature in correspondence with said bit control signal.

10. The driving apparatus as claimed in claim 9, wherein said scan driver supplies said rising ramp waveform during a time corresponding to said width of the control signal.

11. The driving apparatus as claimed in claim 8, wherein said temperature sensor divides the low temperature into a plurality of temperature levels, and generates said different bit control signals for each temperature level.

12. The driving apparatus as claimed in claim 11, wherein said set-up control signal generator generates a control signal having a larger width as the temperature level goes lower, and said scan driver supplies said rising ramp waveform during a time corresponding to said width of the control signal.

13. A driving apparatus for a plasma display panel, comprising:

a scan driver for supplying a rising ramp waveform in a set-up interval and a falling ramp waveform in a set-down interval;

a first temperature sensor for sensing a driving temperature of the panel to generate a first bit control signal;

a second temperature sensor for sensing a driving temperature of the panel to generate a second bit control signal;

a set-up control signal generator for generating a first control signal such that an application time of the rising ramp waveform can be controlled in correspondence with said first bit control signal and for applying the first control signal to the scan driver; and a set-down control signal generator for generating a second control signal such that an application time of the falling ramp waveform can be controlled in correspondence with said second bit control signal and for applying the second control signal to the scan driver.

14. The driving apparatus as claimed in claim 13, wherein said first temperature sensor generates first different bit control signals at a low temperature and at a temperature more than the low temperature, and said second temperature generates second different bit control signals at a high temperature and a temperature less than the high temperature.

15. The driving apparatus as claimed in claim 14, wherein said set-up control signal generator sets a width of said first control signal such that a width of the first control signal applied at said low temperature is larger than that of the first control signal applied at said temperature more than the low temperature in correspondence with said first bit control signal, and said set-down control signal generator sets a width of said second control signal such that a width of the second control signal applied at said high temperature is narrower than that of the second control signal applied at said temperature less than the high temperature in correspondence with said second bit control signal.

16. The driving apparatus as claimed in claim 15, wherein said scan driver supplies said rising ramp waveform during a time corresponding to said width of the first control signal, and supplies said falling ramp waveform during a time corresponding to said width of the second control signal.

17. The driving apparatus as claimed in claim 14, wherein said first temperature sensor divides the low temperature into a plurality of temperature levels and generates said first different bit control signals for each low temperature level, and said second temperature sensor divides the high temperature into a plurality of temperature levels and generates said second different bit control signals for each high temperature level.

18. The driving apparatus as claimed in claim 17, wherein said set-up control signal generator generates a first control signal having a larger width as the low temperature level goes lower, and said scan driver supplies said rising ramp waveform corresponding to said width of the first control signal.

19. The driving apparatus as claimed in claim 17, wherein said set-down control signal generator generates a second control signal having a narrower width as the high temperature level goes higher, and said scan driver supplies said falling ramp waveform corresponding to said width of the second control signal.

20. A method of driving a plasma display panel, comprising the steps of:

applying a rising ramp waveform to a scan electrode in a set-up interval;

applying a falling ramp waveform to the scan electrode in a set-down interval following said set-up interval; and differently setting an application time of said falling ramp waveform applied to the scan electrode at a high temperature and at a temperature less than the high temperature.

21. The method as claimed in claim 20, wherein said application time of the falling ramp waveform at said high temperature is set to be shorter than that of the falling ramp waveform at said temperature less than the high temperature.

22. The method as claimed in claim 21, wherein said high temperature is divided into a plurality of temperature levels, and said application time of the falling ramp waveform is more shortly set as said temperature level goes higher.

23. A method of driving a plasma display panel, comprising the steps of:

applying a rising ramp waveform to a scan electrode in a set-up interval;

applying a falling ramp waveform to the scan electrode in a set-down interval following said set-up interval; and differently setting an application time of said rising ramp waveform applied to the scan electrode at a low temperature and at a temperature more than the low temperature.

24. The method as claimed in claim 23, wherein said application time of the rising ramp waveform at said low temperature is set to be longer than that of the rising ramp waveform at said temperature more than the low temperature.

25. The method as claimed in claim 24, wherein said low temperature is divided into a plurality of temperature levels, and said application time of the rising ramp waveform is longer set as said temperature level goes lower.

26. The method as claimed in claim 23, wherein a slope of the rising ramp waveform applied at said low temperature is equal to that of the rising ramp waveform applied at said temperature more than the low temperature.

* * * * *